United States Patent [19]

Ruby et al.

[11] Patent Number: 4,924,628

[45] Date of Patent: May 15, 1990

[54] PREFABRICATED SLIDER WINDOW SYSTEM WITH LIFT-OUT WINDOWS

[75] Inventors: James A. Ruby, Fombell, Pa.; Rolf-Peter Lange, Nürnberg, Fed. Rep. of Germany; Randy C. Hoover, Lovettsville, Va.

[73] Assignee: Rehau AG & Co., Rehau, Fed. Rep. of Germany

[21] Appl. No.: 234,312

[22] Filed: Aug. 18, 1988

[51] Int. Cl.[5] ..... E06B 1/00; E05D 13/00

[52] U.S. Cl. ..... 49/380; 49/404; 49/408; 49/453; 49/DIG. 2

[58] Field of Search ..... 49/380, 453, 408, DIG. 2, 49/404, 471; 160/90, 91

[56] References Cited

U.S. PATENT DOCUMENTS

| | | | |
|---|---|---|---|
| 3,208,111 | 9/1965 | Grossman | 49/453 X |
| 3,226,779 | 1/1966 | Rust | 49/453 X |
| 3,600,857 | 8/1971 | La Barge et al. | 49/404 |
| 3,636,661 | 1/1972 | Strawsine | 49/453 X |
| 3,859,754 | 1/1975 | Budich et al. | 49/471 X |
| 3,978,617 | 9/1976 | Eventoff | 49/453 X |
| 4,042,004 | 8/1977 | Kwan | 49/408 X |
| 4,259,813 | 4/1981 | Winner et al. | 49/380 X |
| 4,281,477 | 8/1981 | Kaminaga | 49/453 |
| 4,286,716 | 9/1981 | Budich et al. | 49/404 X |

FOREIGN PATENT DOCUMENTS

| | | | |
|---|---|---|---|
| 1601466 | 10/1981 | United Kingdom | 49/408 |

*Primary Examiner*—Philip C. Kannan

*Attorney, Agent, or Firm*—Spencer & Frank

[57] ABSTRACT

A prefabricated slider window system includes a main frame made from extruded thermoplastic members. Windows are mounted in the main frame for horizontal sliding movement. The main frame includes a bottom frame portion having channels for guiding the bottom sides of the windows, and a top frame portion having channels for guiding the top sides of the windows. The channels are deeper in the top frame portion than in the bottom frame portion to permit the windows to be raised out of the channels in the bottom frame portion. The raised windows can then be removed from the main frame so that the outdoor sides of the windows can be cleaned.

12 Claims, 3 Drawing Sheets

FIG. 1
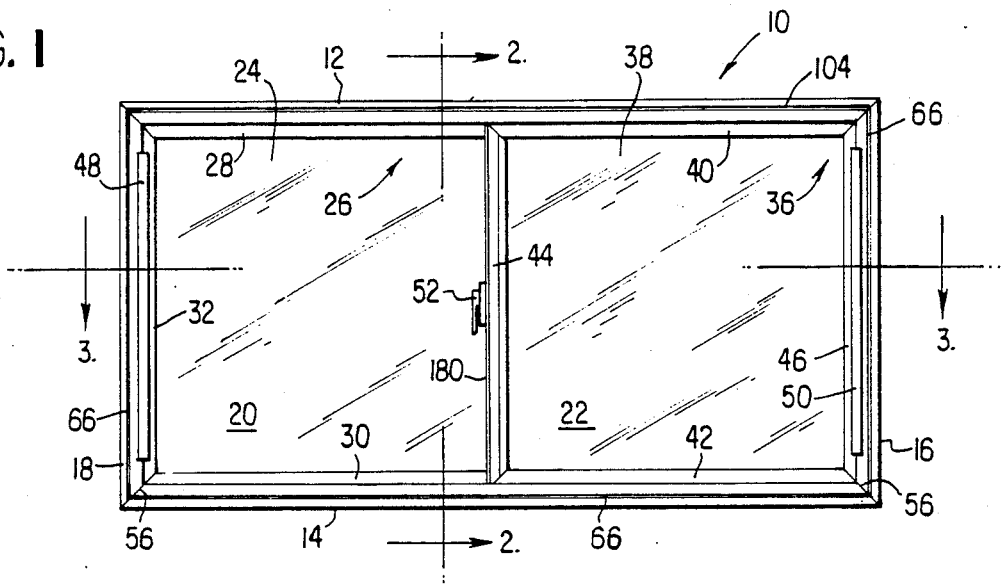
FIG. 6
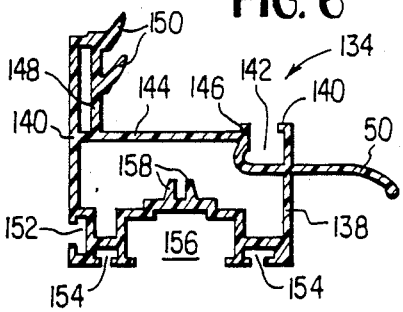
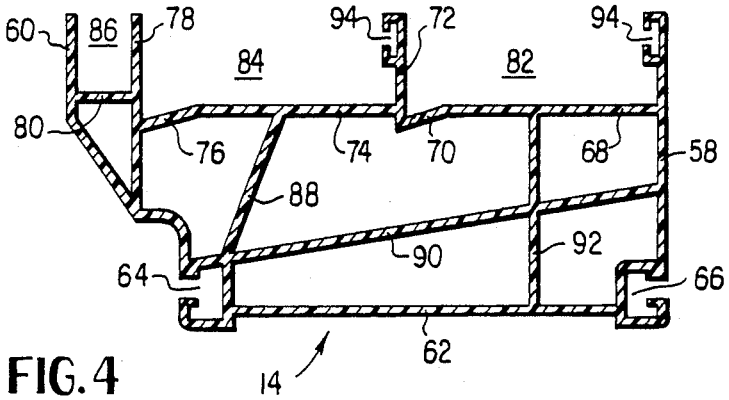
FIG. 4
FIG. 7
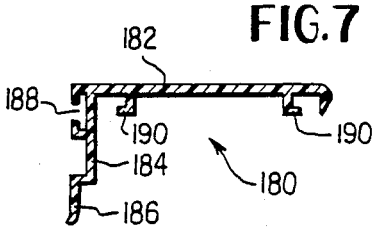
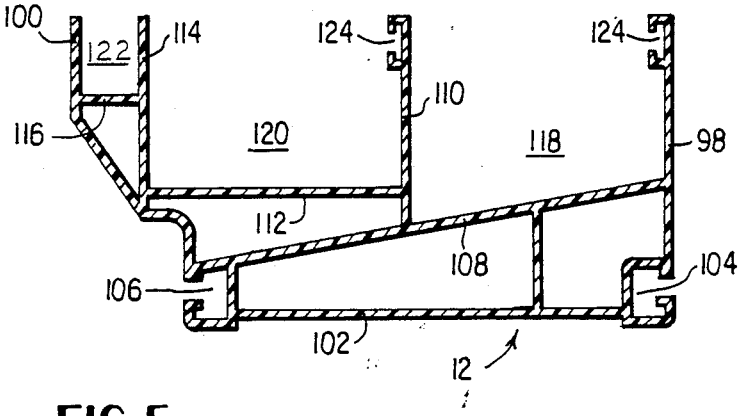
FIG. 5
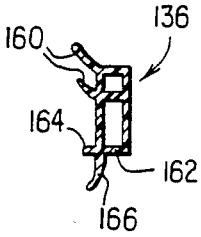
FIG. 8
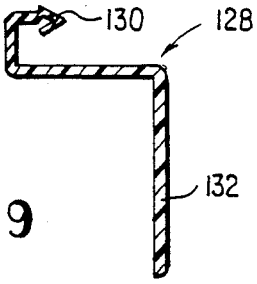
FIG. 9

PREFABRICATED SLIDER WINDOW SYSTEM WITH LIFT-OUT WINDOWS

BACKGROUND OF THE INVENTION

The present invention is directed to a prefabricated window system, and more particularly to a prefabricated slider window system having a main frame which mounts two windows for lateral sliding movement.

Prefabricated window systems are frequently used, both for new construction and for replacement purposes, in order to provide high quality at a moderate cost. The desirable attributes of a prefabricated window system are easier to state than to achieve. The window system should be relatively inexpensive both to purchase and to install, but it should nevertheless offer excellent security against the elements. Furthermore, the window system should be sufficiently rugged to withstand many years of hard use, without the window sashes sticking. The window system should also have an attractive appearance and it should be relatively easy to clean the window panes in order to maintain the attractive appearance.

A "double-hung" window system is perhaps the most familiar type of window system in residential construction. In a typical double-hung window system two sashes are mounted so that they are vertically moveable, with one sash being positioned above the other when the window system is in a closed condition. In a typical "slider" window system, on the other hand, there are two window sashes which are mounted for horizontal rather than vertical movement. When the slider window system is in its closed condition the window sashes are positioned side-by-side at the same height.

The S 771 (TM) prefabricated double-hung window system of Rehau Inc., having an office in Leesburg, Virginia, is described in pending application Ser. No. 06/929,303, filed Nov. 12th, 1986. This window system includes a rectangular main frame having top and bottom frame portions which are joined by side frame portions. To reduce manufacturing costs all of the frame portions, which are made of extruded vinyl, have substantially the same cross-sectional configuration. The frame portions provide channels which, on the side frame portions, serve to guide two window sashes and a screen member so that they can be raised or lowered. Each sash carries a glazing unit having two spaced-apart window panes. To facilitate cleaning of the outdoor-side of the glazing units, the bottom ends of the sashes are pivotably connected to attachment members which slide in channels in the side frame portions. At the tops of the sashes are mounted releasable latch mechanisms which normally extend into the channels of the side frame portions. However, these latch mechanisms can be withdrawn to permit the upper ends of the sashes to be pivoted away from the main frame and toward the interior of the building. This permits a person in the interior of the building to clean the outdoor-side of the glazing units.

This technique for gaining access to the outdoor-sides of the glazing units cannot be directly transferred to a slider window system, since the slider sashes are guided by channels in the top and bottom frame portions rather than the side frame portions. One result of this difference, for example, is that the slider sashes are not pivotably supported by attachment elements which slide in channels in the side frame portions. Nevertheless, one might attempt to adapt the technique to a slider window system by pivotably attaching one end of each slider sash to attachment elements which slide in channels of the top and bottom frame portions. Latch mechanisms for engaging the top and bottom frame portions might then be placed at the other ends of the slider sashes to permit the sashes to be pivoted toward the interior of the buildings somewhat like pages of a book. In effect, a double-hung window system would be rotated by 90° to transform it into a slider window system. This, however, would require the presence of various elements which would not otherwise be needed in a slider window system. Furthermore, the downward force on a sash when it is pivoted out of the slider main frame might push the attachment members in opposite directions, causing the sash to become mis-aligned with the main frame and perhaps permitting the sash to crash unexpectedly to the floor.

SUMMARY OF THE INVENTION

An object of the invention is to facilitate the cleaning of the outdoor sides of glazing units in a slider window system.

Another object of the invention is to provide a slider window system having a main frame with channels which guide window sashes for horizontal movement, with the sashes including glazing units and being removable from the main frame to permit the outdoor sides of the glazing units to be cleaned.

These and other objects which will become apparent in the ensuing detailed description can be obtained by providing a slider window system which includes first and second rectangular windows. The system also includes a rectangular main frame in which the windows are mounted for horizontal sliding movement. The main frame has a bottom frame portion with channels to slidably guide the bottom sides of the windows and a top frame portion to slidably guide the top sides of the windows. The channels in the top frame portion are deeper than the channels in the bottom frame portion so that the windows can be lifted upward into the channels of the top frame portion, thereby raising the bottom sides of the windows out of the channels in the bototm frame portion to permit the windows to be pivoted out of the main frame.

BRIEF DESCRIPTION OF THE DRAWINGS

FIG. 1 is a front view illustrating the indoor side of the slider window in accordance with the present invention;

FIG. 4 is a cross-sectional view of the bottom portion of the main frame, the connecting frame portions having the same cross-sectional configuration;

FIG. 5 is a cross-sectional view of the top portion of the main frame;

FIG. 6 is a cross-sectional view of a sash portion having a slide handle;

FIG. 7 is a cross-sectional view of an interlock panel;

FIG. 8 is a cross-sectional view of a glazing bead which on the sash portion; and FIG. 9 is a cross-sectional view of a nailing fin which can be used to mount the main frame in a building.

DESCRIPTION OF THE PREFERRED EMBODIMENT

Figure 2:
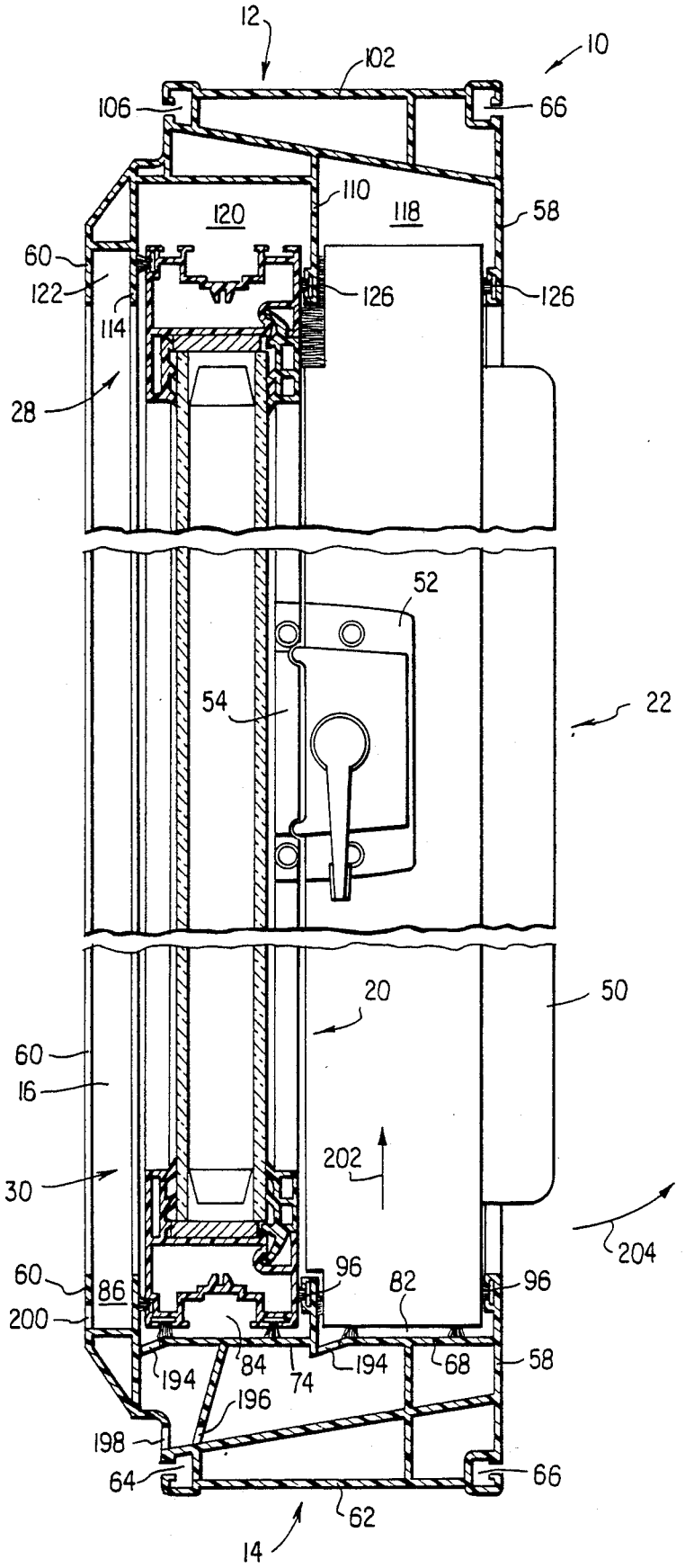
FIG. 2 is a sectional view, partially broken away, taken along line 2—2 of FIG. 1.

In FIG. 1, a slider window system in accordance with the invention includes a main frame 10 having top frame portion 12, bottom frame portion 14, and connecting frame portions 16 and 18. Windows 20 and 22 are slidably guided in main frame 10. Window 20 includes a glazing unit 24 which is mounted in a sash 26, the glazing unit 24 having at least one window pane. Sash 26 has a top side 28, a bottom side 30, a left side 32, and right side 34 (see FIG. 3). Similarly, window 22 includes a sash 36 in which a glazing unit 38 is mounted. Sash 36 has a top side 40, a bottom side 42, a left side 44, and a right side 46. A left side 32 of sash 26 carries a slide handle 48 and the right side 46 of sash 36 carries a slide handle 50. A latch 52 mounted on left side 44 of sash 36 cooperates with a keeper 54 (see FIG. 2) mounted on right side 34 of sash 26 to lock windows 20 and 22 in the closed position.

The four frame portions 12–18 of frame 10 are made from an extruded thermoplastic such as vinyl. The frame portions 10–18 are fixed to one another, by being welded at the four corners 56. The term "weld" means that the vinyl is locally heated so that the frame portions are fused together at the corners and the fused regions are smoothed before solidifying so as to present a pleasing appearance.

FIG. 4 illustrates the cross-sectional profile of bottom frame portion 14, the connecting frame portions 16 and 18 have the same profile. As a result, during fabrication of window systems a long extruded vinyl element (not illustrated) can be cut into lengths appropriate for either frame portion 14 or the connecting frame portions 16 and 18.

Frame portion 14 includes a vertical indoor-facing wall 58 and a vertical outdoor-facing wall 60. A horizontal wall 62 is disposed at the bottom. At the outdoor end of wall 62 is a slot 64, and at the indoor end is a slot 66.

One end of a lateral wall 68 is connected to wall 58, and the other end of wall 68 has a downwardly sloping portion 70 which is joined to a vertical wall 72. One end of a lateral wall 74 is connected to wall 72, and the other end has a downwardly sloping portion 76. Vertical wall 78 is connected to portion 76 and to horizontal wall 80. Between vertical walls 58 and 72 is a window channel 82 and between vertical walls 72 and 78 is a window channel 84. A screen channel 86 is provided between vertical walls 60 and 78. Internal walls 88, 90, and 92 provide bracing. Slots 94 at the upper ends of vertical walls 58 and 72 receive brush seals 96 (see FIG. 2).

FIG. 5 illustrates the cross-sectional configuration or profile of top frame portion 12. Top frame portion 12 includes a vertical indoor-facing wall 98 and a vertical outdoor-facing wall 100. Frame portion 12 also includes a horizontal outer wall 102, at the indoor end of which is a slot 104. A slot 106 is provided at the outdoor end of wall 102. A sloping wall 108 is connected to wall 98 and a vertical wall 110 is connected to wall 108. A horizontal wall 112 connects wall 110 to a vertical wall 114, which is connected to wall 100 by a horizontal wall 116. Between vertical walls 98 and 110 is a window channel 118; between vertical wall 110 and wall 114 is a window channel 120; and between vertical walls 100 and 114 is a screen channel 122. Slots 124 on walls 98 and 110 receive brush seals 126 (see FIG. 2).

FIG. 5 is drawn with outer wall 102 on the bottom (in the assembled window system, it is actually positioned at the top) to facilitate comparison with FIG. 4. It should be noted that window channel 82 is shallower than window channel 118, and that window channel 84 is also shallower than window channel 120.

With reference to FIGS. 4 and 5, slots 64 and 106 are provided on the outdoor side of the slider window system to facilitate mounting it in a building. For this purpose a nailing fin 128 as shown in FIG. 9 may be employed. Nailing fin 128 has an arrowhead portion 130, which can be pounded through the outside slots 64 and 106, and an attachment portion 132 which can then be nailed to the building (not illustrated) in which the slider window system is installed. Slots 66 and 104 on the indoor side are provided for special purposes, as when two slider window systems are to be mounted side-by-side. In such a situation mullion covers (not illustrated) may be pounded into the indoor slots to tie the window systems together. If they are not needed for this purpose, slots 66 and 104 are preferably concealed by molding strips (not illustrated) against which the main frame 10 rests when it is installed in the building.

Window 22 will now be described, starting with the right side 46 of sash 36. Right side 46 includes a sash portion 134 as shown in FIG. 6 and a glazing bead 136 as shown in FIG. 8.

In FIG. 6, sash portion 134 includes an indoor-facing wall 138 and an outdoor-facing wall 140. Slide handle 50 extends from wall 138. At the top of wall 138 is an abutment 140, which overhangs a cavity 142. A wall 144 is connected to wall 140 and terminates in abutment 146. A wall 148 is connected to wall 144 and bears glazing fins 150.

Near the bottom of wall 140 is a slot 152. Slots 154 are provided in a bottom or outer portion, and between slots 154 is a cavity 156. ScreW bosses 158 extend from a wall bordering cavity 156.

Sash portion 134 is cut from an extruded length of thermoplastic having the cross-sectional configuration illustrated in FIG. 6. Most of the thermoplastic is preferably vinyl, but glazing fins 150 are made of a more resilient thermoplastic which is co-extruded with the vinyl.

In FIG. 8, glazing bead 136 is also a co-extruded element mostly of vinyl but having resilient glazing fins 160. Glazing bead 136 also includes a base wall 162, a flange 164, and a descending leg 166.

Figure 3:
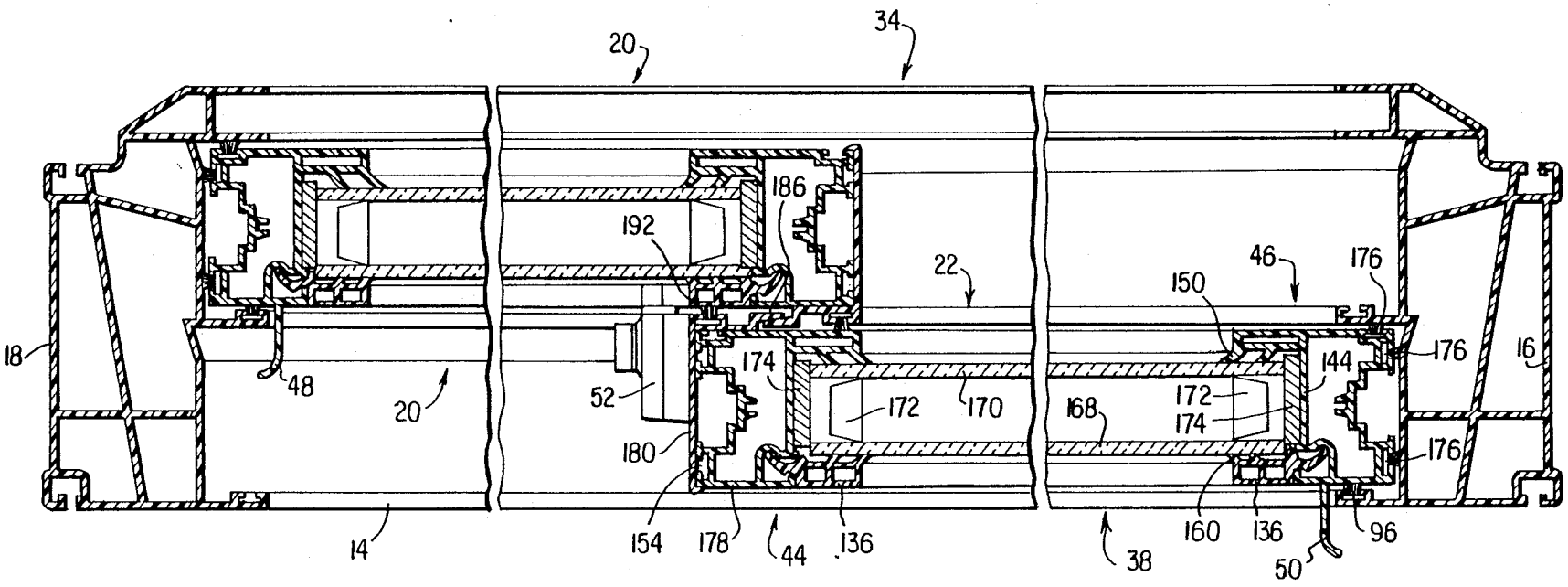
FIG. 3 is a sectional view, partially broken away, taken along line 3—3 of FIG. 1.

Turning next to FIG. 3, glazing unit 38 includes an indoor window pane 168 and an outdoor window pane 170 which are held apart by spacers 172. Reference number 174 identify glazing blocks.

Referring next to FIGS. 3, 6, and 8, the cooperation of sash portion 134 and glazing bead 136 to form right side 46 of sash 36 (see FIG. 1) will now be described. The sash portion 134 and the glazing unit 38 are positioned with respect to each other so that glazing fins 160 resiliently engage pane 170 and glazing block 174 lies against wall 144. The glazing fins 160 of glazing bead 136 are then directed toward pane 168, and leg 166 is lodged in cavity 142. Flange 164 is supported by abutment 146 and base wall 162 is supported by abutment 140. The presence of glazing unit 38 prevents glazing bead 136 from rotating in the direction toward glazing fins 150, and consequently glazing bead 136 is securely attached to sash portion 134, with glazing unit 38 being sandwiched between glazing fins 150 and 160. Brush seals 176 are inserted into slots 152 and 154.

Left side 44 of sash 36 employs a sash portion 178 having the same configuration as sash portion 134, except that slide handle 50 is not present. A glazing bead 136 is mounted on sash portion 178 in a manner previously described. Brushed seals are not lodged into slots 152 and 154 of sash portion 178. Instead, slot 152 is left vacant, and the slots 154 are used to mount an interlock panel 180.

The cross-sectional configuration of interlock panel 180 is shown in FIG. 7. Panel 180 includes a wall 182, which is connected to a leg 184 terminating in an interlock lip 186. A slot 188 is provided on leg 184, and mounting fingers 190 extend from wall 182. Interlock panel 180 is mounted on sash portion 178 by sliding the mounting fingers 190 into the slots 154 of sash portion 178 (the mounting fingers 190 are not illustrated in FIG. 3 due to the reduced size of the drawing). A brush seal 192 is mounted in slot 188.

Top and bottom sides 38 and 42 of sash 36 employ sash portions 178 (that is, having the same configuration as sash portion 134 in FIG. 6, except without the handle 50), and glazing beads 136. During fabrication of window 22, the four sash portions are supported in a fixture (not illustrated) and welded at the corners. Glazing unit 38 is then installed and glazing beads 136 are snapped in.

As will be apparent from FIGS. 2 and 3, the construction of window 20 is the same as that described above for window 22.

Referring next to FIGS. 2 and 4, drainage holes 194 are drilled in the sloping portions 70 and 76 of bottom frame portion 14. Bottom frame portion 14 also has a drainage hole 196 through wall 188 and outlet drainage hole 198. A drainage hole 200 is provided for screen channel 86.

Returning to FIG. 2, the removal of windows 20 and 22 from main frame 10 will now be described. During normal usage, window channels 118 and 120 (see FIG. 5) in top frame portion 12 constitute dead air spaces. However, to remove window 22 in order to permit the outdoor side of its glazing unit to be cleaned, window 22 is lifted, in the direction of arrow 202, into channel 118. Channel 118 is dimensioned to permit the lowered edge of window 22 to clear the indoor-facing wall 58 (see FIG. 4) of bottom frame portion 14, after which window 22 can be tilted in the direction of arrow 204 to remove it from main frame 10. It will be apparent that window 20 can be lifted into channel 120 (see FIG. 5) and then pivoted out of main frame 10 in the same way. It will also be apparent that, after the windows have been cleaned, they can be re-installed in main frame 10 by lifting them into channels 118 and 120 and then permitting them to fall back to their normal positions in channels 82 and 84.

It will be understood that the above description of the present invention is susceptible to various modifications, changes, and adaptations, and the same are intended to be comprehended within the meaning and range of equivalents of the appended claims.

What we claim is:

1. A slider window system, comprising:

a first rectangular window with a top side and a bottom side and with a first end and a second end;

a second rectangular window with a top side and a bottom side and with a first end and a second end;

a rectangular main frame to mount the windows for horizontal sliding movement, the main frame including an elongated bottom frame portion having a first channel in which the bottom side of the first window is slidably guided, and having a second channel in which the bottom side of the second window is slidably guided, an elongated top frame portion having a first channel in which the top side of the first window is slidably guided and having a second channel in which the top side of the second window is slidably guided, the first and second channels of the top frame portion being deeper than the first and second channels of the bottom frame portion to permit the windows to be lifted upward by a predetermined distance into the channels of the top frame portion, the predetermined distance by which the windows can be lifted being sufficient to raise the bottom sides of the windows out of the channels of the bottom frame portion, and first and second connecting frame portions joined to the top and bottom frame portions, each connecting frame portion having a respective first channel which communicates with the first channels of the top and bottom frame portions and having a respective second channel which communicates with the second channels of the top and bottom frame portions;

a keeper attached to the first window adjacent the second end thereof; and a manually operable latch attached to the second window adjacent the first end thereof, the latch being selectively engageable with the keeper when the windows are disposed at a predetermined position with respect to one another so as to selectively permit or prevent the windows from sliding with respect to one another, wherein the first end of the first window is lodged in the first channel of one of the connecting frame portions and the second end of the second window is lodged in the second channel of the other of the connecting frame portions when the windows are disposed at the predetermined position with respect to one another.

2. The window system of claim 1, wherein the bottom frame portion comprises an elongated extruded thermoplastic member having a predetermined cross-sectional configuration, and wherein the top frame portion comprises an elongated extruded thermoplastic member having a predetermined cross-sectional configuration, the cross-sectional configurations being different.

3. The window system of claim 2, wherein the connecting frame portions comprise extruded thermoplastic members having substantially the same cross-sectional configuration as the thermoplastic member of the bottom frame portion.

4. The window system of claim 2, wherein the top and bottom frame portions have regions which face the interior of the main frame and regions which do not face the interior of the main frame, the channels being provided in the regions facing the interior of the main frame, and wherein the exterior configurations of the regions of the top and bottom frame portions which do not face the interior of the main frame are substantially the same.

5. The window system of claim 1, wherein the bottom frame portion comprises an indoor-facing vertical wall, a first laterally disposed wall connected to the indoor-facing vertical wall, an intermediate vertical wall connected to the first laterally disposed wall and spaced apart from the indoor-facing vertical wall, a second laterally disposed wall connected to the intermediate vertical wall, and a further vertical wall connected to the second lateral wall and spaced apart from the intermediate vertical wall, the first channel of the bottom frame portion being defined by the indoor-facing vertical wall, intermediate vertical wall, and first lateral wall, and the second channel of the bottom frame portion being defined by the intermediate vertical wall, the further, vertical wall, and the second lateral wall.

6. The window system of claim 5, wherein the top frame portion comprises an indoor-facing vertical wall, a first laterally disposed wall connected to the indoor-facing wall of the top frame portion, an intermediate vertical wall connected to the first laterally disposed wall of the top frame portion and spaced apart from the indoor-facing wall of the top frame portion, a second laterally disposed wall connected to the intermediate vertically disposed wall of the top frame portion, and a further vertical wall connected to the second lateral wall of the top frame portion and spaced apart from the intermediate wall of the top frame portion, the first channel of the top frame portion being defined by the indoor-facing vertical wall, first lateral wall, and intermediate vertical wall of the top frame portion, and the second channel of the top frame portion being defined by the intermediate vertical wall, second lateral wall, and further vertical wall of the top frame portion.

7. The window system of claim 6, wherein the vertical walls of the top and bottom frame portions have inner ends which are directed toward the interior of the main frame, and wherein the distance between the inner end of the indoor-facing vertical wall of the bottom frame portion and the first lateral wall of the bottom frame portion is less than the distance between the inner end of the indoor-facing vertical wall of the top frame portion and the first lateral wall of the top frame portion;

the distance between the inner end of the intermediate vertical wall of the bottom frame portion and the first lateral wall of the bottom frame portion is less than the distance between the inner end of the intermediate vertical wall of the top frame portion and the first lateral wall of the top frame portion;

the distance between the inner end of the intermediate vertical wall of the bottom frame portion and the second lateral wall of the bottom frame portion is less than the distance between the inner end of the intermediate vertical wall of the top frame portion and the second lateral wall of the top frame portion; and the distance between the inner end of the further vertical wall of the bottom frame portion and the second lateral wall of the bottom frame portion is less than the distance between the inner end of the further vertical wall of the top frame portion and the second lateral wall of the top frame portion.

8. The window system of claim 6, wherein the bottom frame portion further comprises an elongated sealing element extending into the first channel of the bottom frame portion and attached to the indoor-facing vertical wall of the bottom frame portion, and elongated sealing element extending into the second channel of the bottom frame portion and attached to the intermediate vertical wall of the bottom frame portion.

9. The window system of claim 8, wherein the top frame portion further comprises an elongated sealing element extending into the first channel of the top frame portion and attached to the indoor-facing vertical wall of the top frame portion, and an elongated sealing element extending into the second channel of the top frame portion and attached to the intermediate vertical wall of the top frame portion.

10. The window system of claim 1, wherein the top side of the first window has a predetermined width and the first channel of the top frame portion has a predetermined width that does not substantially exceed the width of the top side of the top side of the first window, wherein the top side of the second window has a predetermined width and the second channel of the top frame portion has a predetermined width that does not substantially exceed the width of the top side of the second window, wherein the bottom side of the first window has a predetermined width and the first channel of the bottom frame portion has a predetermined width that does not substantially exceed the width of the first channel of the bottom frame portion, and wherein the bottom side of the second window has a predetermined width and the second channel of the bottom frame portion has a predetermined width that does not substantially exceed the width of the second channel of the bottom frame portion.

11. A slider window system, comprising:

a first rectangular window with a top side and a bottom side;

a second rectangular window with a top side and a bottom side; and a rectangular main frame to mount the windows for horizontal sliding movement, the main frame including an elongated bottom frame portion having a first channel in which the bottom side of the first window is slidably guided, and having a second channel in which the bottom side of the second window is slidably guided, and an elongated top frame portion having a first channel in which the top side of the first window is slidably guided and having a second channel in which the top side of the second window is slidably guided, the first and second channels of the top frame portion being deeper than the first and second channels of the bottom frame portion to permit the windows to be lifted upward by a predetermined distance into the channels of the top frame portion, wherein the bottom frame portion includes an indoor-facing vertical wall, a first laterally disposed wall connected to the indoor-facing vertical wall, an intermediate vertical wall connected to the first laterally disposed wall and spaced apart from the indoor-facing vertical wall, a second laterally disposed wall connected to the intermediate vertical wall, and a further vertical wall connected to the second lateral wall and spaced apart from the intermediate vertical wall, the first channel of the bottom frame portion being defined by the indoor-facing vertical wall, intermediate vertical wall, and first lateral wall, and the second channel of the bottom frame portion being defined by the intermediate vertical wall, the further vertical wall, and the second lateral wall, and wherein the first lateral wall has a horizontal portion and a sloping portion with a drainage hole, and the second lateral wall has a horizontal portion and a sloping portion with a drainage hole.

12. A slider window system, comprising:

a first rectangular window with a top side and a bottom side;

a second rectangular window with a top side and a bottom side; and a rectangular main frame to mount the windows for horizontal sliding movement, the main frame including an elongated bottom frame portion having a first channel in which the bottom side of the first window is slidably guided, and having a second channel in which the bottom side of the second window is slidably guided, and an elongated top frame portion having a first channel in which the top side of the first window is slidably guided and having a second channel in which the top side of the second window is slidably guided, the first and second channels of the top frame portion being deeper than the first and second channels of the bottom frame portion to permit the windows to be lifted upward by a predetermined distance into the channels of the top frame portion, the predetermined distance by which the windows can be lifted being sufficient to raise the bottom sides of the windows out of the channels of the bottom frame portion, wherein the bottom frame portion includes an indoor-facing vertical wall, a first laterally disposed wall connected to the indoor-facing vertical wall, an intermediate vertical wall connected to the first laterally disposed wall and spaced apart from the indoor-facing vertical wall, a second laterally disposed wall connected to the intermediate vertical wall, and a further vertical wall connected to the second lateral wall and spaced apart from the intermediate vertical wall, the first channel of the bottom frame portion being defined by the indoor-facing vertical wall, intermediate vertical wall, and first lateral wall, and the second channel of the bottom frame portion being defined by the intermediate vertical wall, the further vertical wall, and the second lateral wall, wherein the top frame portion includes an indoor-facing vertical wall, a first laterally disposed wall connected to the indoor-facing wall of the top frame portion, an intermediate vertical wall connected to the first laterally disposed wall of the top frame portion and spaced apart from the indoor-facing wall of the top frame portion, a second laterally disposed wall connected to the intermediate vertically disposed wall of the top frame portion, and a further vertical wall connected to the second lateral wall of the top frame portion and spaced apart from the intermediate wall of the top frame portion, the first channel of the top frame portion being defined by the indoor-facing vertical wall, first lateral wall, and intermediate vertical wall of the top frame portion, and the second channel of the top frame portion being defined by the intermediate vertical wall, second lateral wall, and further vertical wall of the top frame portion, and wherein the first lateral wall of the top frame portion slopes and the second lateral wall of the top frame portion is horizontal.

* * * * *